US006135040A

United States Patent [19]

Tice et al.

[11] Patent Number: 6,135,040

[45] Date of Patent: Oct. 24, 2000

[54] FELLING MACHINE

[75] Inventors: William A. Tice; Moshe Shloush; Burton L. Grocke, all of Knoxville, Tenn.

[73] Assignee: Tice Engineering and Sales, Inc., Tenn.

[21] Appl. No.: 09/150,151

[22] Filed: Sep. 9, 1998

[51] Int. Cl.[7] ..... D05B 19/00

[52] U.S. Cl. ..... 112/470.04; 112/163; 112/318

[58] Field of Search ..... 112/470.04, 470.01, 112/220, 221, 318, 322, 163, 167

[56] References Cited

U.S. PATENT DOCUMENTS

| | | | |
|---|---|---|---|
| 5,189,971 | 3/1993 | Frankel et al. | 112/220 |
| 5,458,075 | 10/1995 | Tice et al. | 112/470.04 |
| 5,839,382 | 11/1998 | Tice et al. | 112/470.04 |
| 5,860,377 | 1/1999 | Akahane et al. | 112/470.01 |
| 5,913,276 | 6/1999 | Kurono et al. | 112/470.01 |

*Primary Examiner*—Peter Nerbun
*Attorney, Agent, or Firm*—Luedeka, Neely & Graham, PC

[57] ABSTRACT

An electronically geared felling machine employs physical separation of the needles and loopers to provide significant ergonomic and functional advantages. The felling machine includes a needle servo motor for driving the needles in a sewing motion and a looper servo motor for driving the loopers in their sewing motion. The motion of the needles and loopers are electronically geared to enable these sewing parts to move in concert to produce a plurality of stitchings in materials. Materials may be moved through the sewing area of the felling machine by use of feed rollers positioned fore and aft of the needles. The feed rollers are driven by servo motors. Pneumatic cylinders urge the feed rollers downwardly against the materials to enable the feed rollers to maintain continuous contact with the materials and to maintain continuous movement of the materials through the sewing area of the machine. Electronic gearing of the felling machine's sewing parts is enabled by a computer which uses servo motor positional information to calculate motion commands that are sent to the servo motors.

18 Claims, 4 Drawing Sheets

FELLING MACHINE

TECHNICAL FIELD

The present invention relates to felling machines used for simultaneous sewing of a plurality of stitchings, such as the double stitching used to join two separate pieces of denim to form the inseam of a pair of blue jeans. More particularly, the present invention relates to a felling machine which utilizes electronic gearing of the needles, loopers, and other sewing parts to achieve significant ergonomic and functional advantages.

BACKGROUND

Felling machines are commonly used in the apparel industry for sewing two parallel series of stitches, or stitchings simultaneously. Such parallel stitchings are typically formed by use of two needles and two loopers for forming chain stitches. The felling machine can be used to close a "tube" formed from one or more pieces of material where the parallel stitchings are sewn at or near opposed edges of the tube. Felling machines are also commonly used to join two separate pieces of overlapped material. The inseams and outseams of blue jeans, for example, are usually joined by double stitchings sewn with a felling machine. The double stitchings enhance the strength and durability of the seams.

Felling machines of the conventional type mechanically link the needles with the loopers so that the needles and loopers are synchronized to form stitches. The mechanical linkages are carried through what is known as an "arm" with a "throat" being defined by the open space area created between the arm and the needles. In felling machines used for sewing blue jeans, a "folder" device is positioned in the throat area. The felling machine operator feeds two separate pieces of denim material into the folder which produces an overlapping fold at the edges of the two denim pieces. The folded materials are then fed to the sewing area of the felling machine which joins the materials by placing two parallel stitchings along the fold.

The ergonomic and functional disadvantages of conventional felling machines are numerous and easily appreciated. The felling machine arm is an obstruction and constant source of noise, heat, and failure due to its high number of mechanical parts. Sewing speed is limited by the inertia and friction created by the mechanical linkages. To maintain higher machine operating speeds, the length of the machine arm and throat is kept to a minimum. Power is needed to accelerate and decelerate the mechanical linkages. The mechanical linkages must be lubricated periodically. The minimal amount of working space available to the operator for feeding materials into the folder demands that the operator use unnatural and stressful positioning of the hands and body in order to adequately feed the folder. Carpal tunnel syndrome is a common medical problem among felling machine operators.

Therefore, there is a need for a felling machine which employs physical and mechanical separation of the needle head and loopers.

SUMMARY

With regard to the foregoing and other objects, the invention in one aspect provides a felling machine having a base and a sewing head stand extending away from and fixedly positioned with respect to the base. A sewing head mounted on the sewing head stand includes a sewing motor, a needle drive mechanism driven by the sewing motor, a needle driven reciprocally by the drive mechanism, and a first encoder for producing first data corresponding to movement of the needles, needle drive mechanism, and sewing motor. A looper stand extends away from and is fixedly positioned with respect to the sewing head. A looper head is mounted on the looper stand and includes an elongate looper arm having a relatively large longitudinal length and a relatively small transverse width and extends longitudinally from the looper stand toward the looper head. A distal end of the looper arm is disposed proximate the needle. The looper head further includes a looper disposed in the distal end of the looper arm proximate the needle, a looper drive mechanism disposed in the looper arm for reciprocally driving the looper, a looper motor for driving the looper drive mechanism, and a second encoder for producing second data corresponding to movement of the looper, looper drive mechanism, and looper motor. Data acquisition and control means are employed to receive the first and second data and to control the sewing and looper motors to electronically gear the looper to the needle so that the needle and looper travel in substantial unison to produce stitches. A user interface is connected to the data acquisition and control system for inputting commands to control operation of the felling machine.

The present invention also provides a felling machine for simultaneously sewing a plurality of stitchings in a material. In this embodiment, the felling machine employs two or more needles which are movable through a range of positions in a sewing motion. A looper head is physically separate from the needle head and includes two or more loopers which are movable through a range of looper positions in a sewing motion. A needle motor drives the needles in their sewing motion, and a needle monitor produces needle position signals substantially continuously corresponding to the positions of the needles. A looper motor drives the loopers, and a looper monitor produces looper position signals substantially continuously corresponding to the positions of the loopers. A data acquisition and control unit receives the needle and looper position signals and electronically gears the movements of the needles and the loopers so that the needles and loopers move in concert with each other. A user interface is connected to the data acquisition and control unit for inputting commands to control operation of the felling machine.

BRIEF DESCRIPTION OF THE DRAWINGS

The preferred embodiments of the invention will now be described in further detail with reference to the drawings wherein like reference characters designate like or similar elements throughout the several drawings as follows.

DETAILED DESCRIPTION OF PREFERRED FMBODIMENTS

Figure 1:
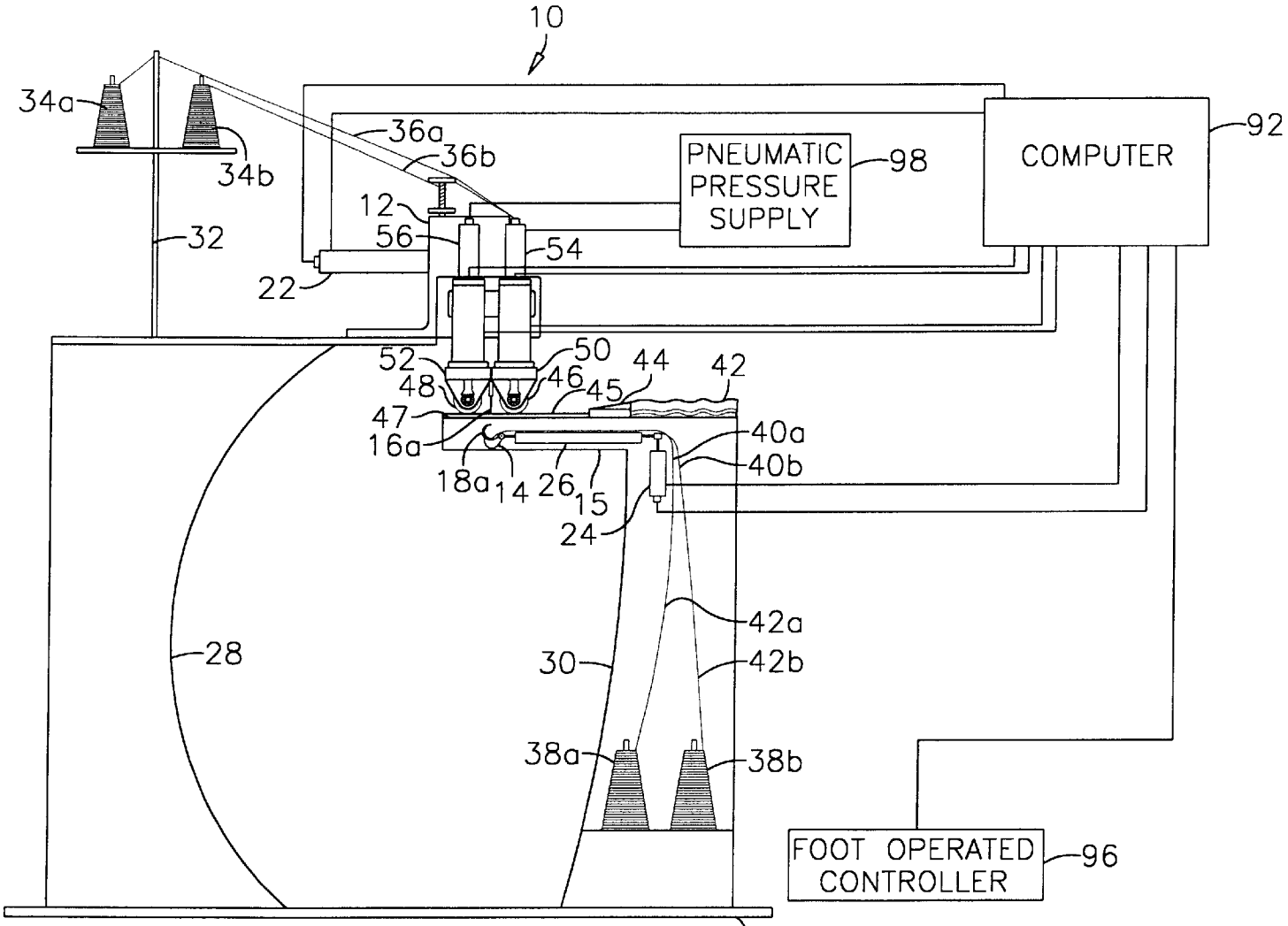
FIG. 1 is a side view of a felling machine in accordance with the present invention showing connections between various components of the felling machine and a computer for providing electronic gearing of the felling machine's sewing parts.

In accordance with a preferred embodiment of the present invention shown in FIG. 1, a felling machine 100 capable of producing two or more stitchings formed from a series of individual stitches is shown. The felling machine 10 includes a needle head 12 and a looper head 14 physically and mechanically separate from each other. In other words, there are no physical or mechanical linkages interconnecting the needle head 10 with the looper head 14 as in conventional felling machines. Separation of the needle head 10 from the looper head 14 eliminates a tremendous amount of mass associated with mechanical linkages that would otherwise be required to synchronize motion of the needles with motion of the loopers. Thus, operation of the felling machine 10 is enhanced since the machine 10 is able to reach top sewing speeds quickly due to lower inertia. Reduction in the number of moving parts reduces noise and heat and lowers energy consumption. Additionally, the lower number of moving parts increases the machine's reliability and maintainability.

Figure 2:
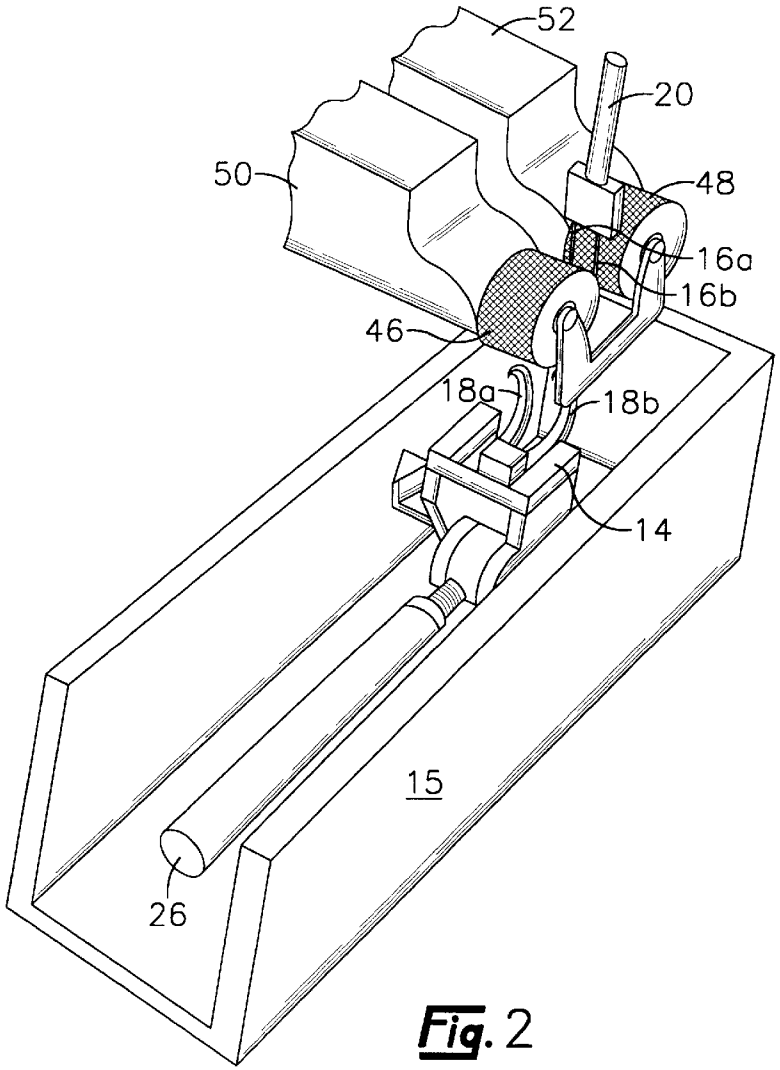
FIG. 2 is an isometric view of the working area of the felling machine showing the needles, loopers, and feed rollers.

As herein described, sewing is enabled by electronic gearing of the needles 16*a*, 16*b* (see also FIG. 2) to the loopers 18*a*, 18*b*. As shown in FIG. 2, the two needles 16*a*, 16*b* are rigidly connected by a needle bar 20 so that the needles move in perfect unison. Although two needles are employed in the embodiment shown in FIG. 2, it will be understood that any number of needles may also be employed with an equal number of loopers. Also, if desired, the loopers 18*a*, 18*b* may be replaced with bobbins to form lockstitches instead of chainstitches which are formed with the loopers 18*a*, 18*b*.

A servo motor 22 is mechanically connected to drive the needle bar 20 in its sewing motion. The loopers 18*a*, 18*b* are likewise driven by a servo motor 24 which connects via a shaft 24 to drive the loopers 18*a*, 18*b* in their sewing motions. In a preferred embodiment, the looper head 14 itself is of conventional design, except instead of being driven by mechanical linkages interconnected to the needle head 12, the looper head 14 of the preferred embodiment is driven by a looper servo motor 24.

With continued reference to FIG. 1, the needle head 12 and its associated hardware are supported by a needle head support stand 28. A thread spool support stand 32 is attached to the needle head support stand 28 as shown to support thread spools 34*a*, 34*b* which supply needle threads 36*a*, 36*b* to the needles 16*a*, 16*b*.

A looper head support stand 30 with an elongate looper arm 15 provides structural support for the head 14 and its associated hardware, including the looper servo motor 24 and linkage 26. In a preferred embodiment, the looper head 14 is about 2.63 inches in length, about 1.88 inches in width, and about 2.31 inches in height. Preferably, the looper arm 15 is about 17 inches in length, about 2.5 inches in width at the sewing end (i.e., the end positioned beneath the sewing head) and about 4 inches in width at the other end, and about 2.5 inches in depth. Two looper thread spools 38*a*, 38*b* supported by the looper head support stand 30 provide looper threads 42*a*, 42*b* to the loopers 18*a*, 18*b*. Thread guides 40*a*, 40*b* are used to guide the looper threads 42*a*, 42*b* to the looper head 14. The needle head support stand 28 and looper head support stand 30 are fixedly positioned relative to one another so that the needles 14*a*, 14*b* and loopers 18*a*, 18*b* operate in concert to produce stitches. In a preferred embodiment, the needle head support stand 28 and looper head support stand 30 extend away from and are fixedly positioned with respect to a base 31. If desired, the floor of a building may be used as the base 31. In a preferred embodiment, the base 31 is a structural element supported by the floor of a building.

The felling machine 10 may be used in a variety of applications where a plurality of stitchings are needed. For example, the felling machine 10 may be used to close opposed edges of a tube formed from a single piece of fabric. In the embodiment shown in FIG. 1, the felling machine is used to join the edges of two separate pieces of fabric, shown generally at 42, to form a seam with double stitching. A typical application of the felling machine 10 shown in FIG. 1 is where two pieces of denim material are sewn to form the inseams and outseams of a pair of blue jeans. A folder 44 of conventional design is positioned atop the pant guide 47 to receive and fold the materials 42, which are fed by a machine operator. The folder 44 essentially overlaps the edges of the materials 42 to produce folded materials 45 which are then sewn by the felling machine 10.

In conventional felling machines, the area available for the machine operator to feed the materials 42 into the folder 44 is minimal due to the presence of the felling machine arm which carries the mechanical linkages connecting the needle head to the looper head. This forces the operator of a conventional felling machine to reach around the felling machine arm and feed the materials 42 into the folder 44 using an unnatural bending of the hands and wrists. Carpal tunnel syndrome is a common result suffered by machine operators as result of the repetitive, stressful motion of the hands and wrists forced upon them by the presence of the felling machine arm. The felling machine arm also obstructs the operator's view of the work area of the machine. To see the work area, the operator must lean to one side while contorting the hands and wrists to feed the materials 42 into the folder 44, which increases strain on the operator's back, neck, and other areas of the human body.

The felling machine of the present invention eliminates many of the ergonomic disadvantages of convention felling machines. As seen in FIG. 1, the felling machine 10 of the present invention does not have an arm to inhibit the working space of the operator. Thus, the operator is able to easily feed the materials 42 into the folder 44 with a more comfortable and natural positioning of the hands and wrists. Elimination of the arm also means that the operator has an unobstructed view of the work area. As a result, the operator is able to maintain an upright and comfortable body posture.

Figure 4:
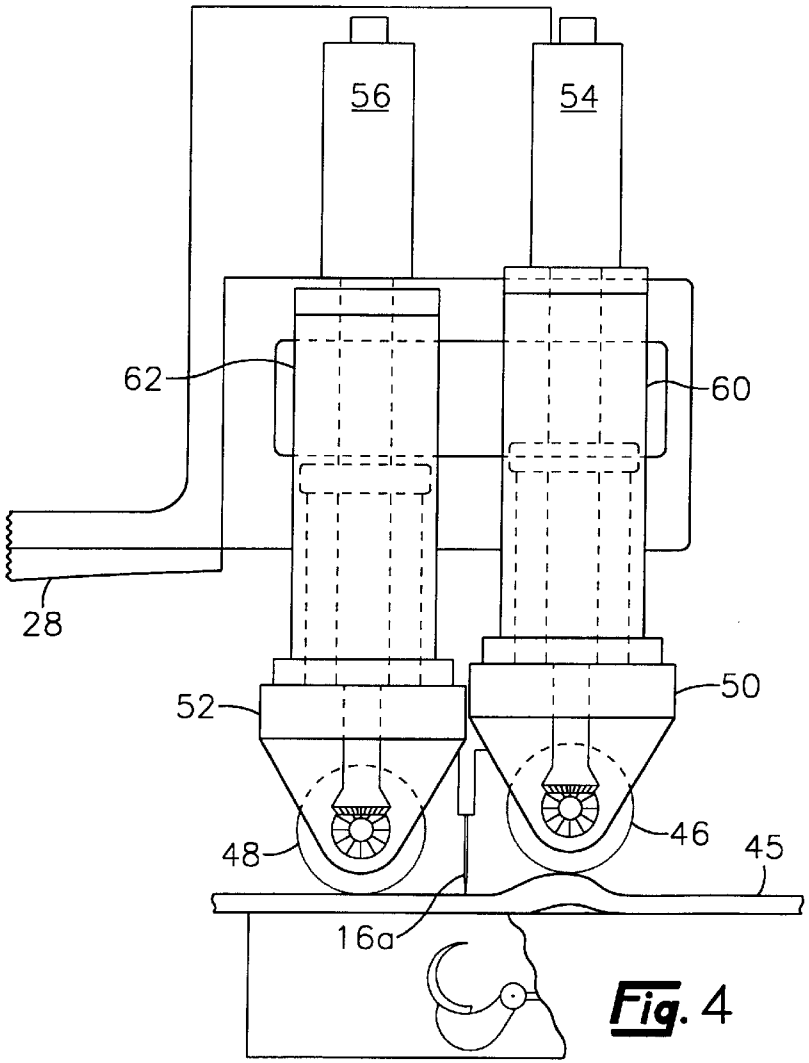
FIG. 4 is a side view of the working area of the felling machine showing the positions of the feed rollers when moving materials which exhibit surface irregularities.
Figure 3:
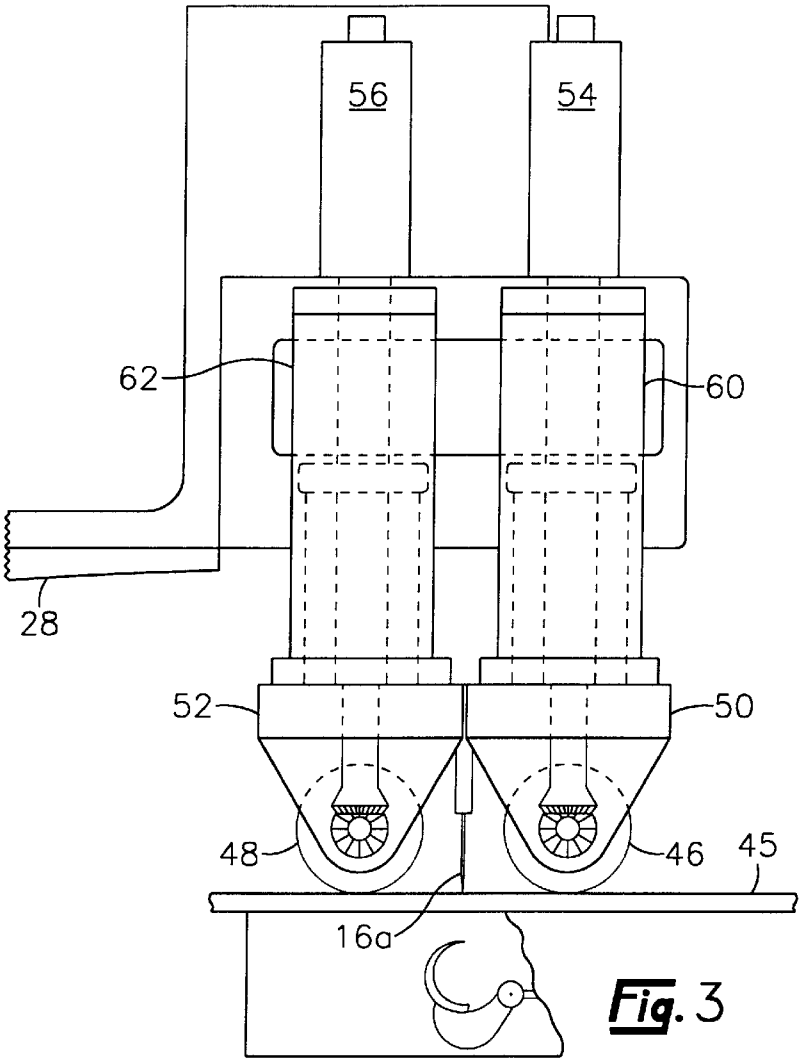
FIG. 3 is a side view of the working area of the felling machine showing the positions of the feed rollers when moving materials which exhibit little or no surface irregularities.

The folded materials 45 produced by the folder 44 may be moved manually to and through the sewing area the of machine 10. In a preferred embodiment shown in FIGS. 1–4, however, the operator moves the folded materials 45 to a front feed roller 46 which pulls the folded materials 45 into the sewing area of the machine 10 where the folded materials 45 are joined by two spaced apart stitchings, the spacing between the stitchings being determined by the spacing of the needles 16*a*, 16*b* and loopers 18*a*, 18*b*. The joined materials are then received by a rear feed roller 48 which assists the front feed roller 46 in moving the materials through the sewing area. As shown in FIGS. 2–4, the needles 16*a*, 16*b* are positioned behind the front feed roller 46 and in front of the rear feed roller 48.

With reference still to FIGS. 1–4, the front feed roller 46 is attached to a front foot 50 which is vertically movable to enable the front feed roller 46 to rise and fall according to surface irregularities of the folded materials 45. FIG. 3 illustrates how the feed rollers 46, 48 remain at substantially the same vertical position when the materials 45 maintain substantially even surface dimensions. In FIG. 4, the front feed roller 46 encounters a surface irregularity in the materials 45 and moves upwardly as it rolls over the irregularity. In similar fashion, the rear feed roller 48 is attached to a rear foot 52 which likewise enables the rear feed roller 48 to rise and fall as the surface of the joined materials dictate. A front pneumatic cylinder 54 and a rear pneumatic cylinder 56 are attached to supporting structure of the needle head 12 to urge the front foot 50 and rear foot 52, respectively, downwardly against the materials 45. This enhances the ability of the feed rollers 46, 48 to maintain continuous contact with the materials 45 and to move the materials 45 through the sewing area without slippage between the feed rollers 46, 48 and the materials 45. Continuous movement of the materials 45 is also enhanced by checkering the surface of the feed rollers 46, 48, as best shown in FIG. 2.

The feed rollers 46, 48 are driven by servo motors. A front feed roller servo motor 60 drives the front feed roller 46 and a rear feed roller servo motor 62 drives the rear servo motor 48 as shown in FIGS. 3 and 4.

As described above, sewing is enabled by electronic gearing of the movements of the sewing parts. Sewing parts are parts that are required to be rigorously moved during sewing operations, including the needles 16*a*, 16*b* and the loopers 18*a*, 18*b*. When using feed rollers 46, 48 herein described, it is preferred that their movement be electronically geared with movement of the needles 16*a*, 16*b* and loopers 18*a*, 18*b*. Position monitoring of the sewing parts is used to electronically gear movement of the sewing parts.

Figure 5:
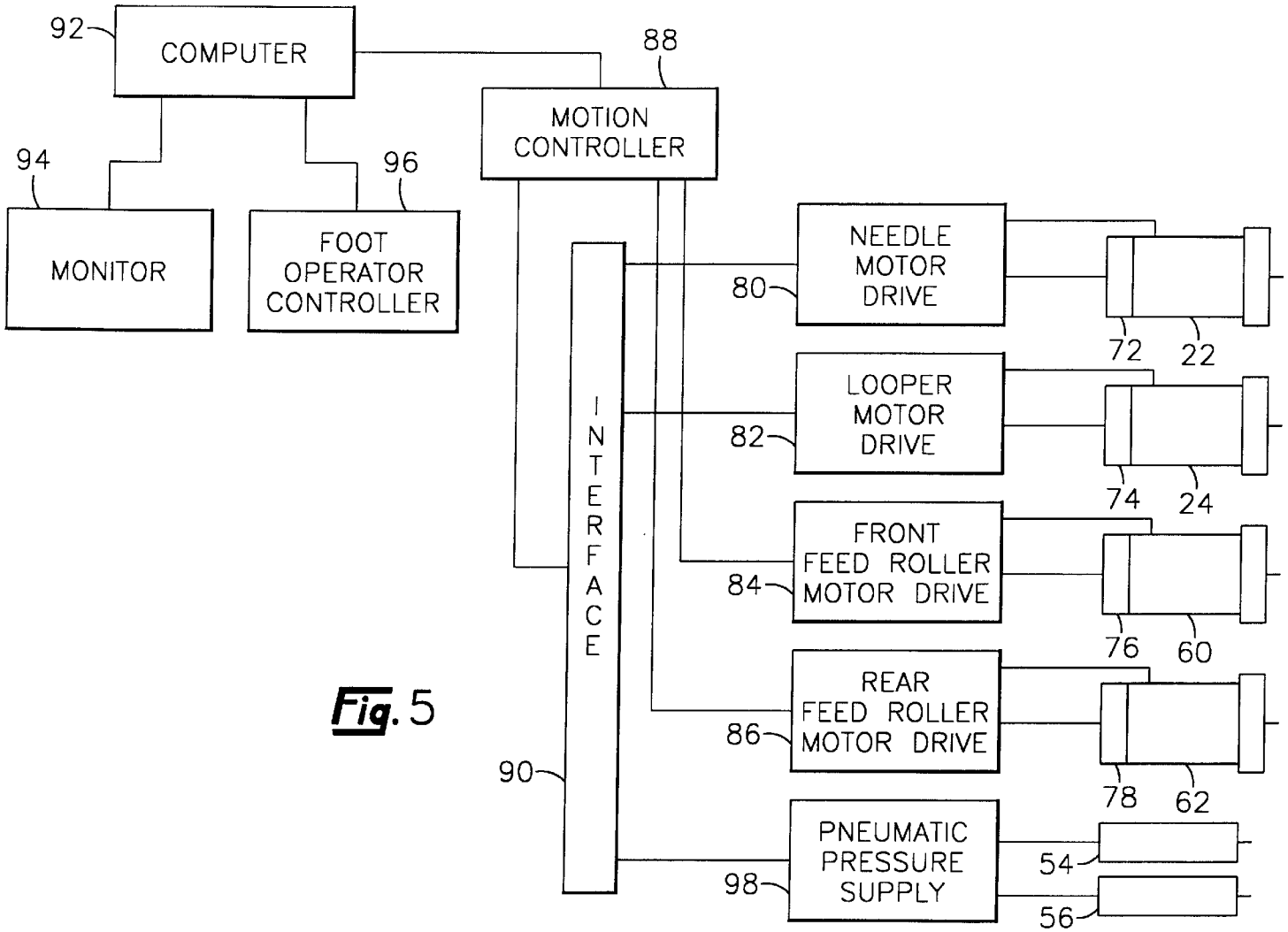
FIG. 5 is a functional block diagram of the feedback and command structure of an electronically geared felling machine in accordance with the present invention.

Position monitoring can be by any effective method of position signaling. In a preferred embodiment as shown in FIG. 5, each of the servo motors is equipped with an encoder 72, 74, 76, and 78 for monitoring the servo motor load. Encoder position information is incremental. Incremental position information can be generally viewed as a series of pulses, or clicks wherein each pulse represents a specific amount of angular movement about the servo motor axis. For example, an encoder that has a resolution of one pulse per degree of movement about the servo motor axis would output 360 pulses for each complete revolution of the servo motor. Servo motor rotation equates to a specific position of the load so that 150 pulses from home position of the needle motor encoder 72 equates, for example, to the needles 16*a*, 16*b* being positioned one inch above the materials 45. In an alternative embodiment, absolute position information is provided in the form of angular position from reference about the servo motor axis so that instead of a series of pulses, the encoder outputs a signal corresponding to 100 degrees when the servo motor has moved 100 degrees from reference. Absolute position information can also be easily determined from incremental position information.

With continued reference to FIG. 5, each servo motor 22, 24, 60, and 62 is connected to a servo motor drive 80, 82, 84, and 86 for providing excitation to the servo motor. Motion commands for each of the servo motors 22, 24, 60, and 62 are generated by a motion controller 88 and then passed to the servo motor drives 80–86 via an interface 90. The interface 90 is either a digital data bus or it is a direct, hardwired link between the motion controller 88 and the servo motor drives 80–86 and pneumatic pressure supply 98 which supplies pneumatic pressure to the feed roller cylinders 54, 56. Motion commands in a preferred embodiment are in the form of analog voltages, but it will be understood that digital motion commands may also be used. Preferably, each motion command utilizes S-curve profiling to reduce machine jerk, and it instructs the corresponding servo motor drive to provide a specific amount of current to the servo motor. The motion controller 88 knows how far each servo motor 22, 24, 60, and 62 must travel in a given time period, so it periodically adjusts the analog voltage level of each motion command to prevent overtravel or undertravel of the servo motor.

For example, to move the loopers 18*a*, 18*b* an analog motion command corresponding to the desired motion of the loopers 18*a*, 18*b* is generated by the motion controller 88 and sent out to the looper motor drive 82. The analog motion command is received by the looper motor drive 82 and used to provide an electrical current for excitation of the looper servo motor 24. Encoder 74 monitors the position of the looper servo motor 24 and outputs this positional information through the looper motor drive 82 to the motion controller 88. Motion controller 88 receives the digital positional information from the looper motor drive 82 and uses it for two purposes. First, the encoder 74 positional information is used by the controller 88 as feedback to determine whether the looper servo motor 24 has traveled to the point where it should be. If commanded motion differs from actual motion by a predetermined distance, then the motion controller 88 increases or decreases the voltage level of the analog motion command to increase or decrease looper servo motor speed. Second, the encoder positional information is used by the controller 88 to limit the torque on the looper servo motor 24. This torque limiter prevents the motion controller 88 from increasing the analog voltage motion command beyond a predetermined limit, thereby limiting the maximum amount of current to be supplied to the looper servo motor 24. In an alternate embodiment, encoder 74 positional information is used by the looper motor drive 82 as feedback to enable comparison of commanded motion with actual motion. In this alternate embodiment, the looper motor drive 82 itself adjusts the current to the looper servo motor 24 to correct any overtravel or undertravel (smart drive).

In a preferred embodiment, ac servo motors are used for the needle and looper servo motors 22, 24 and dc servo motors are used for the feed roller servo motor 60, 62. Servo drives 80, 82 for the ac servo motors 22, 24 are preferably YASKAWA servo drives. Servo drives for each of the ac servo motors 22, 24 are preferably COMPUMOTOR OEM670X servo drives. Encoders 72, 74 for each of the ac servo motors are preferably magnetic encoders, such as SONY MAGNESCALE INC. magnetic rotary encoder RE90B-2048C. Encoder position signals are also routed through the servo drives 80, 82 to the interface 90 for use by the motion controller 88 in calculating motion commands.

As described above, the feed roller servo motors 60, 62 are preferably dc servo motors. Servo drives 84, 86 for each of these servo motors are preferably COMPUMOTOR OEM670X servo drives. Encoders 76, 78 for each of the dc servo motors 60, 62 are preferably optical encoders, such as COMPUTER OPTICAL PRODUCTS, INC. CM350-1000-L. Encoder position signals are routed directly to the motion controller 88. The encoder position is used by the controller 104 as servo motor feedback control.

Referring still to FIG. 5, the motion controller 88, which is part of a computer 92, and its associated software can conceptually be viewed as a plurality of motion command axes such that a command axis is established for each servo motor and its corresponding drive. For example, a command axis is established for the needle motor drive 80, the needle servo motor 22, and the needle servo motor encoder 72. A separate command axis is established for the looper motor drive 82, the looper servo motor 24, and the looper servo motor encoder 74. Each motion command axis calculates motion commands as a function of encoder position information from all servo motors 22, 24, 60, and 62. Motion commands provide the servo motor drives 80–86 with information relating to the desired motion of the servo motors 22, 24, 60, and 62, and each motion command and resulting servo motor motion can generally be viewed a pulse due to its relatively short duration. Faster stitching operations require shorter duration and higher frequency motion commands. The motion controller 88 is programmed to control the position of the servo motors 22, 24, 60, and 62 by generating motion commands corresponding to the frequency and current of these pulses to be supplied to the servo motors. In a preferred embodiment, PC bus motion controller cards, such as GALIL DMC-1000 cards having eight axes of motion control per card with multiple card synchronization, are used within the computer 92. Each axis of the motion controller 88 generates an appropriate motion command for its corresponding servo motor and drive.

Monitoring by the motion controller 88 of encoders 72–78 enables electronic gearing of the loopers 18*a*, 18*b* and the needles 16*a*, 16*b*. Encoder monitoring is used, for example, by designating one of the servo motors as the master with the other servo motors slaved to the master. For example, in a preferred embodiment, the looper servo motor 24 is slaved to the needle servo motor 22, which is the master, so that each slaved controller axis monitors the needle servo motor encoder 72 and generates the appropriate motion command for concerted movement of the slaved servo motors with the needle servo motor 22. In an alternate embodiment, any of the servo motors may be the master. If positional information provided via the encoders 72–78 indicates that one of the slave servo motors is unable to keep up with the master servo motor and lags the master servo motor by, for example, 50 encoder pulses or greater, the motion controller 88 will cause the master servo motor to slow. This effectively flip-flops the identities of the servo motors and the slave motor suddenly becomes the master servo motor.

In a preferred embodiment, the front feed roller servo motor 60 and the rear feed roller servo motor 62 are slaved to the needle servo motor 22 in such a way that movement of the materials 45 is as slow as possible. In other words, when the needles 16*a*, 16*b* move up and clear the materials 45, the feed rollers 46, 48 will begin to move, and the speed of the feed rollers 46, 48 is calculated to achieve the desired material movement in the known time required for the needles 46, 48 to raise to the top of their travel and return to the point of entering the materials 45 again. Consuming the maximum length of time between stitches in order to move the materials 45 dampens otherwise jerky machine motions and reduces or eliminates the problems associated with acceleration and deceleration, thereby enabling the felling machine 10 to achieve the smoothest, tightest stitch possible. In a preferred embodiment, the feed rollers 46, 48 begin their motion when the needle servo motor encoder 72 has output 2800 pulses from home position with the needles 46, 48 rising to a height approximately one fourth of an inch above the pant guide 47, and the feed rollers 46, 48 complete their motion when the needle servo motor encoder 72 has output 4000 pulses from home position and the needles 46, 48 again lower to a height of approximately one fourth of an inch above the plane of the pant guide 47.

As an alternative to the master-slave arrangement of the preferred embodiment, electronic gearing is enabled by generating motion commands without reference to a master. Each controller axis receives encoder positional information from all other encoders and generates motion commands based on the positions of all sewing parts. If encoder positional information indicates that one of the servo motors is unable to keep up with the others and lags the other servo motors by, for example, 50 encoder pulses or greater, then that lagging servo motor is designated as master and all other controller axes are slaved to it to maintain electronic gearing. Therefore, an alternate embodiment is disclosed whereby a master-slave arrangement does not exist until there is a lag by one of the servo motors.

Each encoder 72–78 is equipped with a reference position indicator, enabling the motion controller 88 to command each servo motor 22, 24, 60, and 62 to find the reference point and then move to a "home" position. This home position is used to initialize the felling machine 10 for start of sewing operations. In a preferred embodiment, the operator initiates and controls sewing operations by use of a foot operated controller 96 which produces control signals in response to inputs effected by movement of the operator's foot. The control signals produced by the foot operated controller are input to the computer 92 to control the operation of the felling machine 10. The encoders 72–78 sense movement from the home position and produce signals corresponding to such movements. Initialization (moving servo motors to home position) and stitch pattern selection is enabled by use of a user interface such as, for example, a touch screen computer monitor 94. A user menu software package, such as Visual Basic, is used to generate user interface screens. Stitch patterns are stored in electronic storage, including computer 92 hard disk and other magnetic media, RAM, and ROM, and selected by the user through the touch screen monitor 94.

The computer 92, in addition to enabling the function of electronic gearing of the sewing parts, also enables a variety of other automated functions. One such function enabled by the computer 92 is torque limiting for improved safety. The computer 92 calculates and monitors the current that is required per pulse for each servo motor. When, for example, the needles 16*a*, 16*b* are going through heavy fabric, more current per pulse to the needle servo motor 22 (more torque) is required to maintain the desired speed of operation; i.e., the servo motor 22 torque requirement goes up. Likewise, if the needles 16*a*, 16*b* try to go through a finger or if the materials 45 become jammed between the feed rollers 46, 48, more current will be required to maintain the selected speed of operation. By manual input through the monitor 94 or by default programmer setting, the computer 92 has an established torque limit. This torque limit is continuously compared to the servo motor torque requirement. When a finger is hit by a needle 16*a*, 16*b*, or when some other obstruction causes an excessive amount of require torque, the computer 92 turns off the felling machine 10, thereby preventing further damage to the finger or other obstruction instead of commanding the servo motor 22 to provide torque above the torque limit. This feature also prevents possible self-destruction of the felling machine 10 itself.

Torque limit shut down of the felling machine 10 for blockage of a servo motor is a two-step procedure. First, a user defined current limit prevents the computer 92 from commanding a current level in excess of the defined limit. The current limit will vary depending on the thickness and resistive properties of the material being sewn. For thin materials, a low current limit is set. For thicker materials, a higher current limit is set. Once the current limit is reached, the computer 92 will hold the current at that level until encoder positional information indicates that the blocked servo motor is lagging by, for example, 50 encoder pulses or greater. At this point, the master and slave servo motors flip-flop identifies if the blocked servo motor is a slave. If the blocked servo motor is the master, no flip-flop occurs. If the blocked servo motor continues to lag by, for example, an additional 50 encoder pulses or greater, despite the fact that maximum current is being commanded, then the computer 92 turns off the felling machine 10.

Another function enabled by the computer 92 is real time production and maintenance monitoring of the felling machine 10. The computer 92 monitors the amount of time that the felling machine 10 is being operated, the speed at which it operates, and the power required to operate it over a period of time. This feature enables automated maintenance scheduling of the felling machine 10.

It is contemplated, and will be apparent to those skilled in the art from the foregoing specification, drawings, and examples that modifications and/or changes may be made in the embodiments of the invention. Accordingly, it is expressly intended that the foregoing are illustrative of preferred embodiments only, not limiting thereto, and that the true spirit and scope of the present invention be determined by reference to the appended claims.

What is claimed is:

1. A felling machine for sewing a thread in a material, the felling machine comprising:

a base;

a sewing head stand extending away from and fixedly positioned with respect to said base;

a sewing head mounted on said sewing head stand and including:

a sewing motor;

a needle drive mechanism driven by said sewing motor;

a needle driven reciprocally by said drive mechanism; and a first encoder for producing first data corresponding to movement of the needle, needle drive mechanism and sewing motor;

a looper stand extending away from said base and fixedly positioned with respect to said sewing head;

a looper head mounted on said looper stand and including:

an elongate looper arm having a relatively large longitudinal length and a relatively small transverse width and extending longitudinally from the looper stand toward the looper head, a distal end of said looper arm being disposed proximate said needle;

a looper disposed in the distal end of said looper arm proximate said needle;

a looper drive mechanism disposed in said looper arm for reciprocally driving said looper;

a looper motor for driving said looper drive mechanism; and a second encoder for producing second data corresponding to movement of the looper, looper drive mechanism and looper motor;

a data acquisition and control system receiving said first and second data and controlling said sewing and looper motors to electronically gear said looper to said needle so that said needle and looper travel in substantial unison to produce stitches; and a user interface connected to said data acquisition and control system for inputting commands to control operation of the felling machine.

2. The felling machine of claim 1, further comprising:

a first feed roller for pushing material toward the needle; and a second feed roller for pulling material away from the needle.

3. The felling machine of claim 2, further comprising:

a front foot for supporting said first feed roller, said front foot being movable in at least one dimension;

a rear foot for supporting said second feed roller, said rear foot being movable in at least one dimension;

a first actuator for urging the front foot in a downward direction toward the material; and a second actuator for urging the rear foot in a downward direction toward the material.

4. The felling machine of claim 2, further comprising:

a first feed roller drive mechanism for driving said first feed roller to push material toward the needle;

a first feed roller motor for driving said first feed roller drive mechanism;

a third encoder for producing third data corresponding to movement of the first feed roller, first feed roller drive mechanism, and first feed roller motor;

a second feed roller drive mechanism for driving said second feel roller to pull material away from the needle;

a second feed roller motor for driving said second feed roller drive mechanism; and a fourth encoder for producing fourth data corresponding to movement of the second feed roller, second feed roller drive mechanism, and second feed roller motor.

5. The felling machine of claim 4 wherein said data acquisition and control system is further operable to receive said first, second, third, and fourth data and to control said sewing, looper, first feed roller, and second feed roller motors so that said needle, looper, and first and second feed rollers operate in concert in produce a continuous series of stitches in the material.

6. The felling machine of claim 1 wherein said user interface includes a foot operated controller.

7. The felling machine of claim 1 wherein said data acquisition and control system includes:

a motion controller having multiple control axes for receiving said needle monitor and looper monitor signals and for responding to said needle monitor and looper monitor signals to produce motion commands for each of said sewing and looper motors;

a sewing motor drive interconnected with said sewing motor and said motion controller for receiving motion commands from said motion controller and supplying power to said sewing motor in response to said motion commands; and a looper motor drive interconnected with said looper motor and said motion controller for receiving motion commands from said motion controller and supplying power to said looper motor in response to said motion commands.

8. A felling machine for forming stitches in a material, the felling machine comprising:

a substantially horizontal footing;

a needle head support stand connected to said footing and extending upwardly away from the footing;

a needle head attached to the needle head support stand at a first distance from the footing, said needle head including:

a needle motor;

a needle drive mechanism driven by said needle motor;

a needle driven by said needle drive mechanism; and a needle monitor for producing needle monitor signals corresponding to the position of the needle;

a looper head support stand connected to said footing and extending upwardly away from the footing;

a looper head attached to the looper head support stand at a second distance from the footing which is less than said first distance, said looper head including:

a looper motor;

a looper drive mechanism driven by said looper motor;

a looper mechanically separate from said needle and driven by said looper motor; and a looper monitor for producing looper monitor signals corresponding to the position of the looper;

a data acquisition and control system for receiving said needle and looper monitor signals and controlling said needle and looper motors to electronically gear said looper to said needle so that said needle and looper travel in substantial unison to produce stitches; and a user interface connected to said data acquisition and control system for inputting commands to control operation of the felling machine.

9. The felling machine of claim 8, further comprising:

a front roller for moving material toward the needle; and a rear roller for moving material away from the needle.

10. The felling machine of claim 9, further comprising:

a front foot for supporting said front roller, said front foot being movable in at least one dimension;

a rear foot for supporting said rear roller, said rear foot being movable in at least one dimension;

a front actuator for urging the front foot toward the material; and a rear actuator for urging the rear foot toward the material.

11. The felling machine of claim 9, further comprising:

a front roller drive mechanism for driving said front roller to move material toward the needle;

a front roller motor for driving said front roller drive mechanism;

a front roller monitor for producing front roller monitor signals corresponding to the position of the front roller;

a rear roller drive mechanism for driving said rear roller to move material away from the needle;

a rear roller motor for driving said rear roller drive mechanism; and a rear roller monitor for producing rear roller monitor signals corresponding to the position of the rear roller.

12. The felling machine of claim 11 wherein said data acquisition and control system is further operable to receive said needle, looper, front roller, and rear roller monitor signals and to control said needle, looper, front roller, and rear roller motors so that said needle, looper, front roller, and rear roller operate in concert to produce a continuous series of stitches in the material.

13. The felling machine of claim 8 wherein said user interface includes a foot operated controller.

14. The felling machine of claim 8 wherein said looper head further includes an elongate looper arm having a relatively large longitudinal length and a relatively small transverse width and extending longitudinally from the looper head support stand toward the looper head, a distal end of said looper arm supporting the looper head at said second distance.

15. A felling machine for forming stitches in a material, the felling machine comprising:

a needle head support stand;

a needle head attached to the needle head support stand at a first height, said needle head including:

a needle motor;

a needle drive mechanism driven by said needle motor;

a needle driven by said needle drive mechanism; and a needle monitor for producing needle monitor signals corresponding to the position of the needle;

a looper head support stand fixedly positioned with respect to said needle head support stand;

a looper head attached to the looper head support stand at a second height which is less than said first height, said looper head including:

a looper motor;

a looper drive mechanism driven by said looper motor;

a looper mechanically separate from said needle and driven by said looper motor; and a looper monitor for producing looper monitor signals corresponding to the position of the looper;

a data acquisition and control system for receiving said needle and looper monitor signals and controlling said needle and looper motors to electronically gear said looper to said needle so that said needle and looper travel in substantial unison to produce stitches;

a front roller for moving material toward the needle; and a rear roller for moving material away from the needle.

16. The felling machine of claim 15, further comprising:

a front foot for supporting said front roller, said front foot being movable in at least one dimension;

a rear foot for supporting said rear roller, said rear foot being movable in at least one dimension;

a front actuator for urging the front foot toward the material; and a rear actuator for urging the rear foot toward the material.

17. The felling machine of claim 15, further comprising:

a front roller drive mechanism for driving said front roller to move material toward the needle;

a front roller motor for driving said front roller drive mechanism;

a front roller monitor for producing front roller monitor signals corresponding to the position of the front roller;

a rear roller drive mechanism for driving said rear roller to move material away from the needle;

a rear roller motor for driving said rear roller drive mechanism; and a rear roller monitor for producing rear roller monitor signals corresponding to the position of the rear roller.

18. The felling machine of claim 17 wherein said data acquisition and control system is further operable to receive said needle, looper, front roller, and rear roller monitor signals and to control said needle, looper, front roller, and rear roller motors so that said needle, looper, front roller, and rear roller operate in concert to produce a continuous series of stitches in the material.

* * * * *